US010024069B2

(12) United States Patent
Bond et al.

(10) Patent No.: US 10,024,069 B2
(45) Date of Patent: Jul. 17, 2018

(54) CONSTRUCTION PROP ASSEMBLY

(71) Applicant: Concrete Support Systems of Houston, LLC, Houston, TX (US)

(72) Inventors: Bradley D. A. Bond, Katy, TX (US); Gunter Sengel, Naples, FL (US); Mark Grace, Rochester, NY (US)

(73) Assignee: Concrete Support Systems, Houston, TX (US)

( * ) Notice: Subject to any disclaimer, the term of this patent is extended or adjusted under 35 U.S.C. 154(b) by 746 days.

(21) Appl. No.: 14/542,331

(22) Filed: Nov. 14, 2014

(65) Prior Publication Data

US 2016/0060882 A1 Mar. 3, 2016

Related U.S. Application Data

(60) Provisional application No. 62/044,662, filed on Sep. 2, 2014.

(51) Int. Cl.

| | |
|---|---|
| ***E04G 11/00*** | (2006.01) |
| ***E04G 11/38*** | (2006.01) |
| ***E04G 11/48*** | (2006.01) |
| ***E04G 25/06*** | (2006.01) |
| *E04G 25/04* | (2006.01) |

(52) U.S. Cl.

CPC ..... *E04G 11/38* (2013.01); *E04G 11/48* (2013.01); *E04G 11/483* (2013.01); *E04G 11/486* (2013.01); *E04G 25/065* (2013.01); *E04G 2025/042* (2013.01)

(58) Field of Classification Search

CPC ..... E04G 11/38; E04G 11/48; E04G 11/483; E04G 11/486; E04G 25/065; E04G 25/04; E04G 25/06; E04G 2025/042; F16M 13/027; F16M 13/022

USPC ..... 248/235, 295.11, 297.51, 297.31, 243, 248/200.1, 351, 354.1, 354.3, 354.6, 357; 249/18

See application file for complete search history.

(56) References Cited

U.S. PATENT DOCUMENTS

| | | | | |
|---|---|---|---|---|
| 337,601 A | | 3/1886 | Merrill | |
| 1,382,505 A | * | 6/1921 | Hargey | B25B 1/2484 211/86.01 |

(Continued)

FOREIGN PATENT DOCUMENTS

WO WO2009009898 A1 1/2009

*Primary Examiner* — Anita M King
(74) *Attorney, Agent, or Firm* — Shannon L Warren

(57) ABSTRACT

A construction beam head assembly comprising an improved forming system having one or more fixed beam-head prop assemblies each having an upper portion and a lower portion. The upper portion having a screw-jack threaded shaft assembly and a drop-head The lower portion comprising of a prop and a collar The screw-jack threaded shaft assembly having an external diameter and an external threading The screw-jack threaded shaft assembly attaches to the drop-head The upper portion selectively slides into the lower portion The collar having an internal threading and an internal diameter The internal threading of the collar rotateably attaches to the external threading of the screw-jack threaded shaft assembly of the upper portion. The upper portion and the lower portion adjustably attach to one another with the collar and the screw-jack threaded shaft assembly to provide a variable height of the prop assembly.

16 Claims, 13 Drawing Sheets

(56) References Cited

U.S. PATENT DOCUMENTS

| | | | | | |
|---|---|---|---|---|---|
| 1,781,063 | A * | 11/1930 | Jessen | E04G 25/06 | 248/354.4 |
| 3,822,850 | A * | 7/1974 | Elias | E04G 21/3233 | 248/200.1 |
| 4,122,645 | A * | 10/1978 | Tooley | E04G 11/486 | 248/354.3 |
| 5,031,724 | A * | 7/1991 | Quinn | E04G 25/06 | 182/186.6 |
| 5,590,863 | A * | 1/1997 | Sasaki | E04G 17/14 | 248/354.3 |
| 5,758,854 | A * | 6/1998 | Shih | F16B 37/0864 | 248/354.3 |
| 6,481,912 | B2 * | 11/2002 | Shih | E04G 7/12 | 24/483 |
| 6,612,533 | B2 * | 9/2003 | Biles | B25H 3/006 | 248/125.1 |
| 7,584,932 | B2 | 9/2009 | Shih | | |
| 8,066,247 | B2 * | 11/2011 | Spera | E04G 11/38 | 248/354.1 |
| 8,616,519 | B2 * | 12/2013 | Bacon | E04G 11/483 | 249/18 |
| 2007/0264076 | A1 | 11/2007 | McCracken | | |

* cited by examiner

PRIOR ART

CONSTRUCTION PROP ASSEMBLY

CROSS-REFERENCE TO RELATED APPLICATIONS

This application claims benefit to provisional U.S. Patent Application No. 62/044,662, filed on 2014 Sep. 2.

STATEMENT REGARDING FEDERALLY SPONSORED RESEARCH OR DEVELOPMENT (IF APPLICABLE)

Not applicable.

REFERENCE TO SEQUENCE LISTING, A TABLE, OR A COMPUTER PROGRAM LISTING COMPACT DISC APPENDIX (IF APPLICABLE)

Not applicable.

BACKGROUND OF THE INVENTION

This disclosure relates generally to an improved construction beam head assembly. Examples of construction props can be found in the following list of prior art references: U.S. Pat. No. 3,376,011 A, US 20070264076 A1, WO 2009009898 A1, and U.S. Pat. No. 7,584,932 B2.

None of the above inventions and patents, taken either singularly or in combination, is seen to describe the instant disclosure as claimed. Accordingly, an improved construction beam head assembly would be advantageous.

SUMMARY OF THE INVENTION

Two system and a method of use are disclosed.

First, an improved grid shoring system comprising a one or more fixed beam-head prop assemblies supporting a one or more beams is disclosed. Each of said one or more fixed beam-head prop assemblies comprise an upper portion, a lower portion, a variable height, and a threaded collar. Said upper portion having a screw-jack threaded shaft assembly. Said screw-jack threaded shaft assembly comprises a threaded shaft having an external diameter and an external threading and an upper attachment plate having a plurality of fastening apertures. Said upper portion of said one or more fixed beam-head prop assemblies selectively slide into said lower portion of said one or more fixed beam-head prop assemblies. Said threaded collar comprises an internal threading and an internal diameter. Said internal threading of said threaded collar rotateably attaches to said external threading of said screw-jack threaded shaft assembly of said upper portion. Said lower portion comprises a lower central shaft having an internal diameter being larger than said external diameter of said threaded shaft. Said upper portion and said lower portion adjustably attach to one another by Selectively sliding said threaded shaft in an up and down direction through said lower central shaft of said lower portion. Vertically adjusting said threaded collar along said threaded shaft to select said variable height. Said upper portion comprises a first end cap seat. Said lower portion comprises a second end cap seat. Said upper portion having a drop-head. Said drop-head comprises a bottom plate having a plurality of fastening apertures. Said screw-jack threaded shaft assembly attaches to said drop-head by aligning said plurality of fastening apertures of said bottom plate of said drop-head with said plurality of fastening apertures of said upper attachment plate of said screw-jack threaded shaft assembly, and inserting and locking a one or more nut and bolt assemblies through said plurality of fastening apertures in said bottom plate and said upper attachment plate. Said first end cap seat is selectively attached to said drop-head of said upper portion. Said first end cap seat comprises a variable height. Adjusting said variable height of said first end cap seat comprises adjusting said threaded collar between said upper portion and said lower portions of said one or more fixed beam-head prop assemblies. Said lower portion comprising of a prop and a fixed beam-head. Said fixed beam-head comprising a central shaft having a central shaft having an internal diameter, a first end and a second end, a bottom plate having a plurality of fastening apertures, and a second end cap seat attached around and to said central shaft. Said prop comprising a central shaft having a first end and a second end, and a top plate having a plurality of fastening apertures. Said central shaft of said prop comprises central shaft having a first end aperture and an internal diameter; and Said plurality of fastening apertures of said top plate of said prop align and attach to said plurality of fastening apertures of said bottom plate of said fixed beam-head.

Next, an improved grid shoring system comprising a one or more fixed beam-head prop assemblies supporting a one or more beams. Each of said one or more fixed beam-head prop assemblies comprise an upper portion, a lower portion, a variable height, and a threaded collar. Said upper portion having a screw-jack threaded shaft assembly. Said screw-jack threaded shaft assembly comprises a threaded shaft having an external diameter and an external threading and an upper attachment plate having a plurality of fastening apertures. Said upper portion of said one or more fixed beam-head prop assemblies selectively slide into said lower portion of said one or more fixed beam-head prop assemblies. Said threaded collar comprises an internal threading and an internal diameter. Said internal threading of said threaded collar rotateably attaches to said external threading of said screw-jack threaded shaft assembly of said upper portion. Said lower portion comprises a lower central shaft having an internal diameter being larger than said external diameter of said threaded shaft. Said upper portion and said lower portion adjustably attach to one another by Selectively sliding said threaded shaft in an up and down direction through said lower central shaft of said lower portion, and vertically adjusting said threaded collar along said threaded shaft to select said variable height. Said upper portion comprises a first end cap seat; and Said lower portion comprises a second end cap seat.

Finally, a method of using an improved grid shoring system is disclosed. Said method comprising: supporting a one or more beams on a first end cap seat and a second end cap seat of a one or more fixed beam-head prop assemblies; selectively adjusting a height of said first end cap seat by sliding a threaded shaft in an up and down direction through a lower central shaft of a lower portion, and vertically adjusting a threaded collar along said threaded shaft to select a variable height. Said one or more fixed beam-head prop assemblies comprise Said lower portion having a central shaft, an upper portion having said threaded shaft, Said threaded collar.

BRIEF DESCRIPTION OF THE SEVERAL VIEWS OF THE DRAWING

FIG. 4A comprises dashed lines to indicate which portions of said prop assembly are illustrated in FIG. 4B.

FIG. 9A comprises dashed lines to indicate which portions of said prop assembly are illustrated in FIG. 9B.

DETAILED DESCRIPTION OF THE INVENTION

Described herein is an improved construction beam head assembly. The following description is presented to enable any person skilled in the art to make and use the invention as claimed and is provided in the context of the particular examples discussed below, variations of which will be readily apparent to those skilled in the art. In the interest of clarity, not all features of an actual implementation are described in this specification. It will be appreciated that in the development of any such actual implementation (as in any development project), design decisions must be made to achieve the designers' specific goals (e.g., compliance with system- and business-related constraints), and that these goals will vary from one implementation to another. It will also be appreciated that such development effort might be complex and time-consuming, but would nevertheless be a routine undertaking for those of ordinary skill in the field of the appropriate art having the benefit of this disclosure. Accordingly, the claims appended hereto are not intended to be limited by the disclosed embodiments, but are to be accorded their widest scope consistent with the principles and features disclosed herein.

Figure 1:
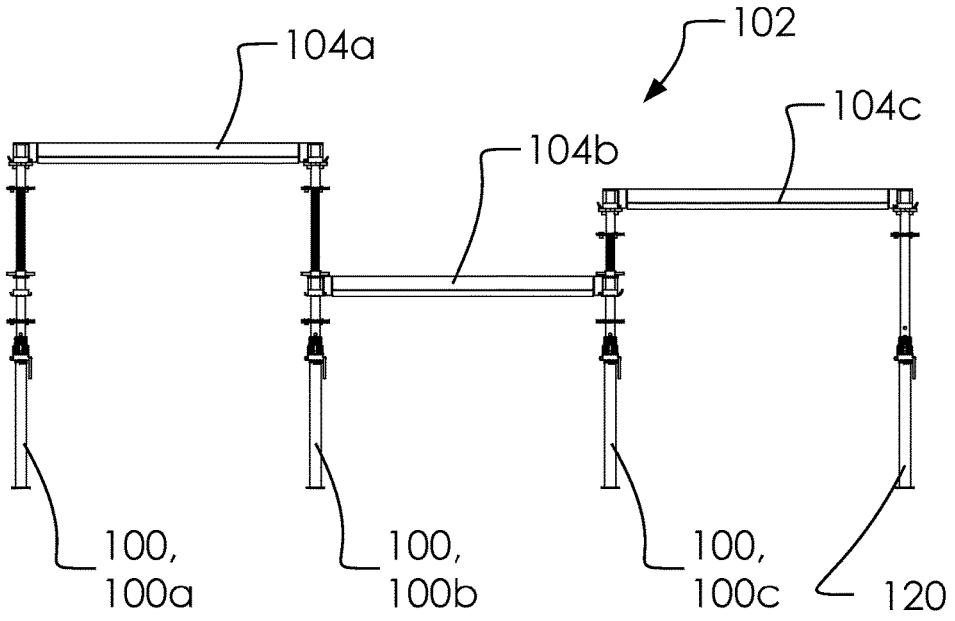
FIG. 1 illustrates an elevated front view an improved grid shoring system comprising of a one or more fixed beam-head prop assemblies and a one or more beams.

FIG. 1 illustrates an elevated front view an improved grid shoring system 102 comprising of a one or more fixed beam-head prop assemblies and a one or more beams. In one embodiment, said one or more fixed beam-head prop assemblies can comprise a first assembly 100*a*, a second assembly 100*b* and a third assembly 100*c*. Hereafter, all of said one or more fixed beam-head prop assemblies can be referred to collectively as a prop assembly 100 (which for this disclosure will be described in more detail as follows). In one embodiment, said one or more beams can comprise a first beam 104*a*, a second beam 104*b*, and a third beam 104*c*, as is known in the art. In one embodiment, said improved construction beam head assembly can comprise an improved method of setting said one or more fixed beam-head prop assemblies to various heights as disclosed herein.

This illustration includes a traditional prop assembly 120, which can comprise a prior art version of said prop assembly 100. Said improved grid shoring system 102 includes said traditional prop assembly 120 as an illustrative element, but said traditional prop assembly 120 is not required to make one of said improved grid shoring system 102. However, said improved grid shoring system 102 can comprise a one or more of a prior art elements, such as said traditional prop assembly 120.

Figure 2:
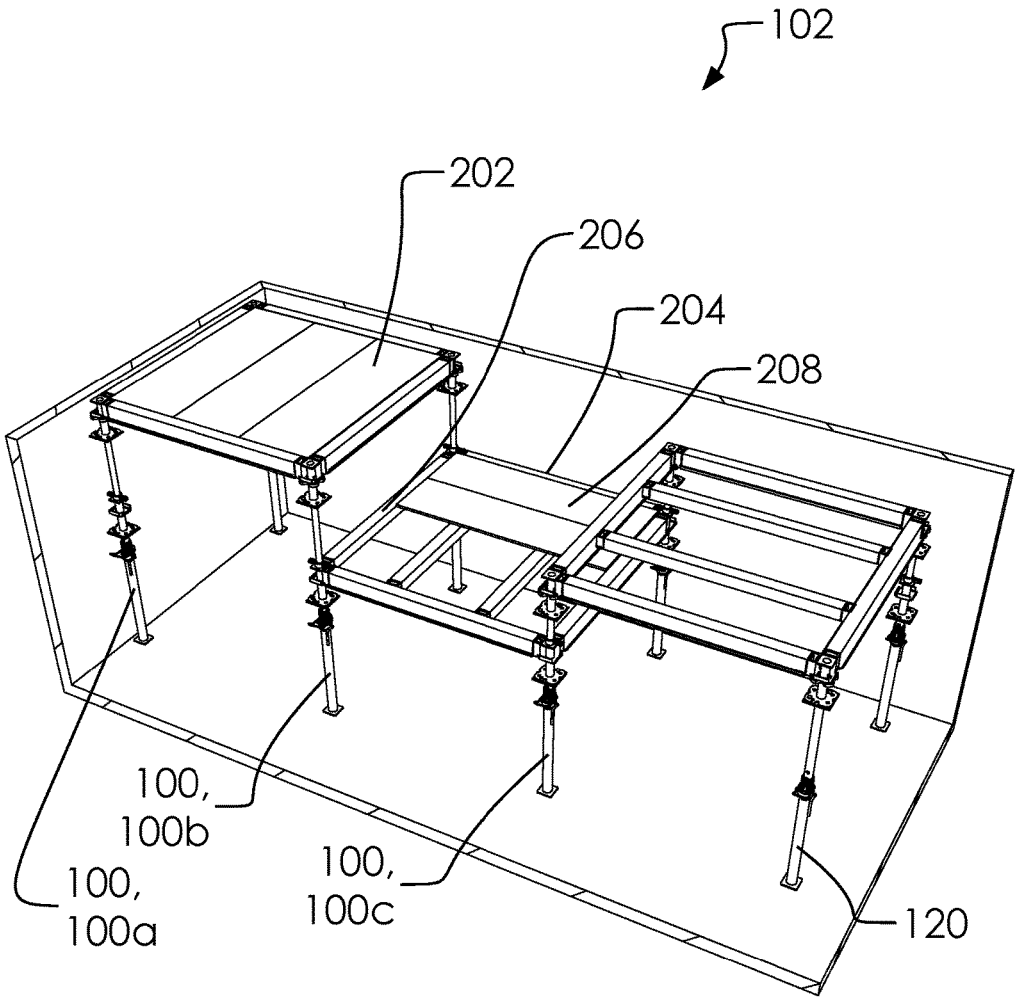
FIG. 2 illustrates a perspective overview of an improved grid shoring system.

FIG. 2 illustrates a perspective overview of said improved grid shoring system 102. In one embodiment, said improved grid shoring system 102 can comprise an example of a grid and panelized system, as is known in the art. In one embodiment, said improved grid shoring system 102 can comprise said one or more fixed beam-head prop assemblies, configured in a grid (such as an array pattern) and releaseably attached to one another by a one or more beams (which can comprise of a plurality of a main beam 204 and/or a secondary beam 206). In one embodiment, said main beam 204 can be referred to as a "stringer" and said secondary beam 206 can be referred to as a "joist", as is known in the art. Further, atop of said beams, a one or more of a panel 202 and/or a plywood sheet 208 can be used to create a concrete working surface, as is known in the art.

In one embodiment, forming said improved grid shoring system 102 can comprise: adjusting a height of each among a one or more fixed beam-head prop assemblies 100; arranging said one or more fixed beam-head prop assemblies 100; attaching said one or more fixed beam-head prop assemblies 100 to one another with a one or more beams; and attaching a one or more panels to said one or more beams.

In one embodiment, said improved grid shoring system 102 can comprise said traditional prop assembly 120, lacking features disclosed herein. In one embodiment, said traditional prop assembly 120 lacks the ability to create a variable height for said one or more fixed beam-head prop assemblies, such as said first assembly 100*a*. That is, in one embodiment, said prop assembly 100 comprises two different variable shoring heights, whereas said traditional prop assembly 120 only has one.

Figure 3A:
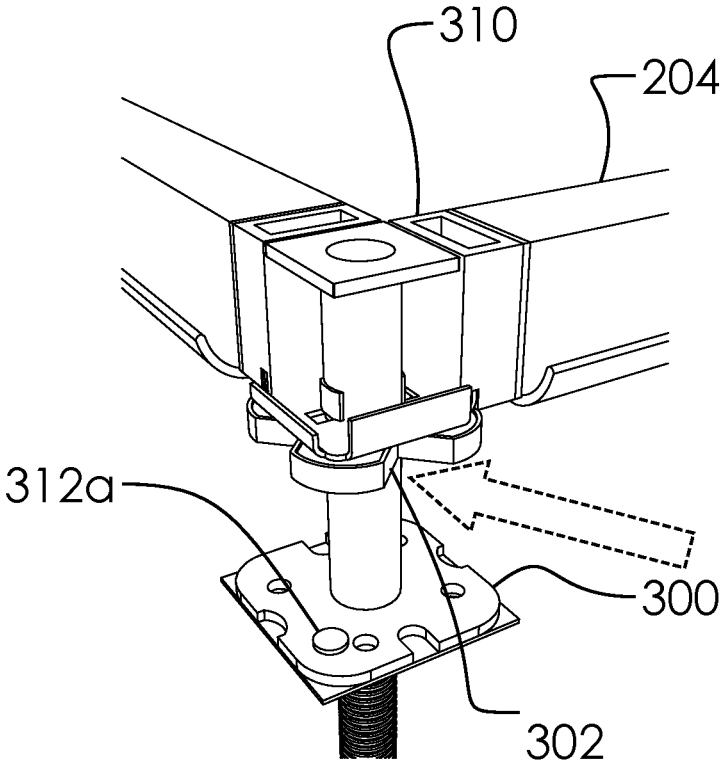
FIGS. 3A and 3B illustrate a perspective overview of a drop-head and of a fixed beam-head.
Figure 3B:
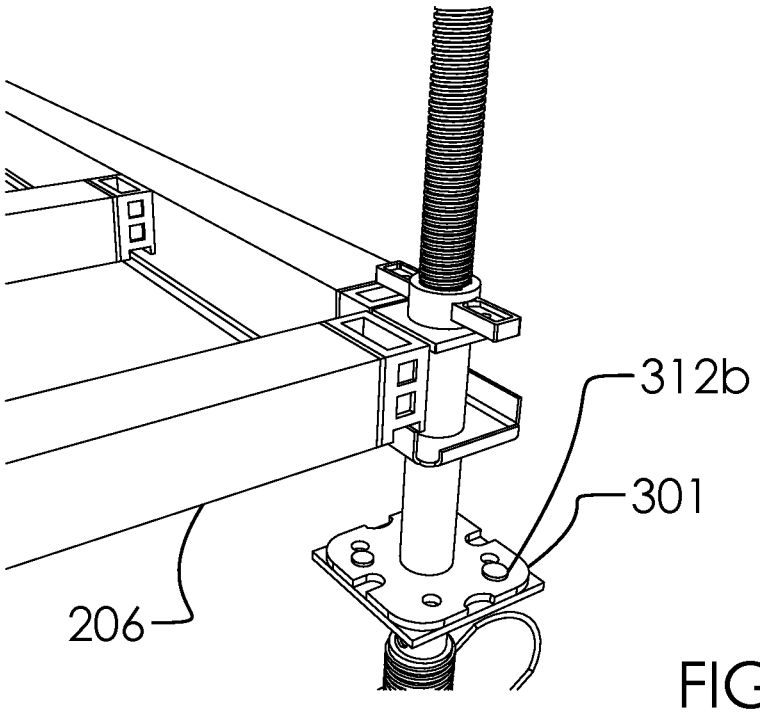

FIGS. 3A and 3B illustrate a perspective overview of a drop-head 300 and of a fixed beam-head 301. In one embodiment, said one or more beams can selectively attach to said drop-head 300. In one embodiment, removing said one or more beams from said drop-head 300 can comprise striking a strike point 302 with a tool (such as a hammer). In one embodiment, said one or more beams will release from said 300 after such a strike, as is known in the art. In one embodiment, referring to said improved grid shoring system 102 as a "grid" can mean that said secondary beam 206 and said main beam 204 are installed onto said fixed beam-head 301 and/or said drop-head 300 at the same height as one another, rather than stacked on one another, as would be common in a "loose" system. In one embodiment, said one or more beams can each comprise an end cap 310 at their ends, as is known in the art. In one embodiment, said end cap 310 can selectively attach to said fixed beam-head 301 and/or said drop-head 300. In one embodiment, said fixed beam-head 301 can be attached to a portion of said first assembly 100*a* with a bolt assembly 312*b*, and said drop-head 300 can be attached to a portion of said first assembly 100*a* with a bolt assembly 312*a*.

Figure 4A:
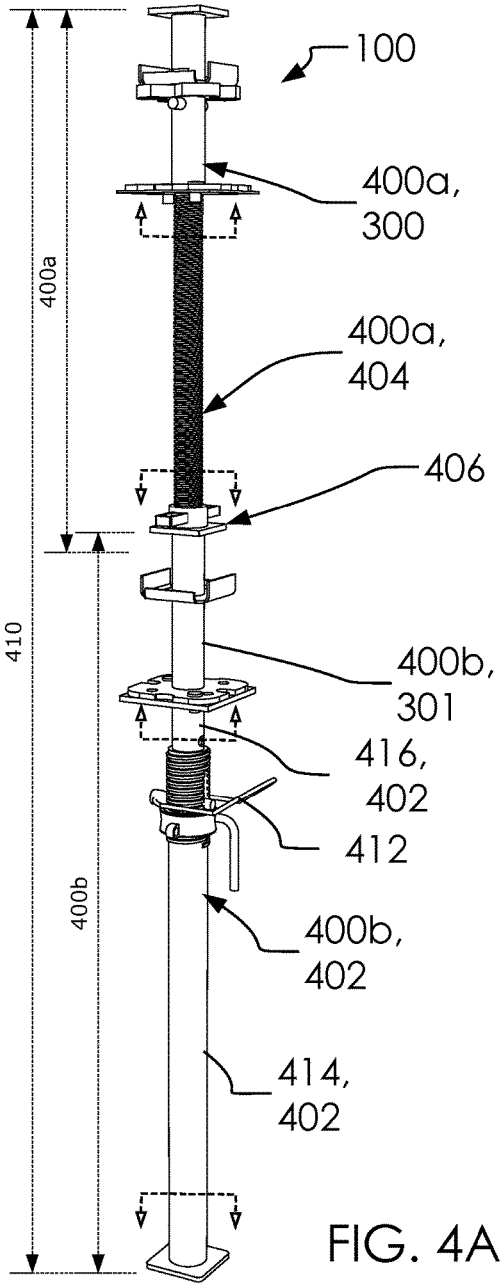
FIGS. 4A and 4B illustrate a perspective overview of said prop assembly.
Figure 4B:
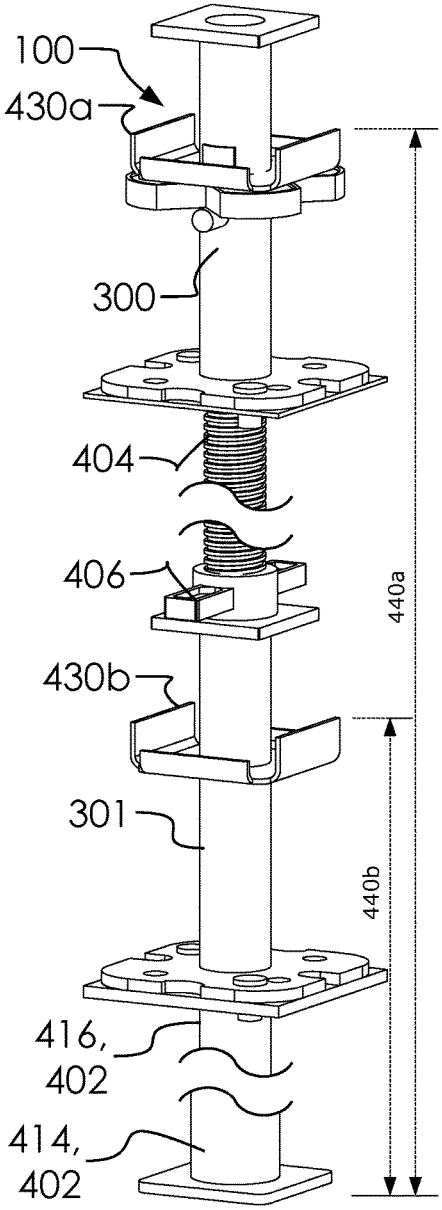

FIGS. 4A and 4B illustrate a perspective overview of said prop assembly 100. FIG. 4A comprises dashed lines to indicate which portions of said prop assembly 100 are illustrated in FIG. 4B. In one embodiment, said prop assembly 100 can comprise an upper portion 400*a* and a lower portion 400*b*. In one embodiment, said upper portion 400*a* can comprise said drop-head 300 and a screw-jack threaded shaft assembly 404. In one embodiment, said lower portion 400*b* can comprise a prop 402 and said fixed beam-head 301. In one embodiment, said prop assembly 100 further comprises a threaded collar 406.

In one embodiment, said upper portion 400*a* and said lower portion 400*b* move relative to one another so as to adjustably change a height 410 of said prop assembly 100. In one embodiment, adjusting said height 410 can comprise rotating said threaded collar 406 relative to said screw-jack threaded shaft assembly 404, as discussed below.

In one embodiment, said prop assembly 100 can comprise a first end cap seat 430*a* attached to a portion of said upper portion 400*a* and a second end cap seat 430*b* attached to a portion of said lower portion 400*b*.

In one embodiment, said lower portion 400*b* can comprise a prop lock 412, a lower exterior portion 414, and an upper interior portion 416. In one embodiment, said lower exterior portion 414 can receive a portion of said upper interior portion 416 allowing said upper interior portion 416 to slide in and out of said lower exterior portion 414 freely. In one embodiment, said prop lock 412 can hold said upper interior portion 416 to said lower exterior portion 414, as is known in the art. Accordingly, said second end cap seat 430*b* of said lower portion 400*b* can comprise a variable height 440*b* as set by adjusting said lower exterior portion 414 and said upper interior portion 416 of said prop 402 with said prop lock 412.

Likewise, said first end cap seat 430*a* can comprise a variable height 440*a* as set by said prop 402 and/or said screw-jack threaded shaft assembly 404, each of which are adjustable in their heights, as disclosed and illustrated herein. In one embodiment, adjusting said variable height 440*a* can comprise adjusting said upper portion 400*a* relative to said lower portion 400*b* as discussed to follow.

Figure 5A:
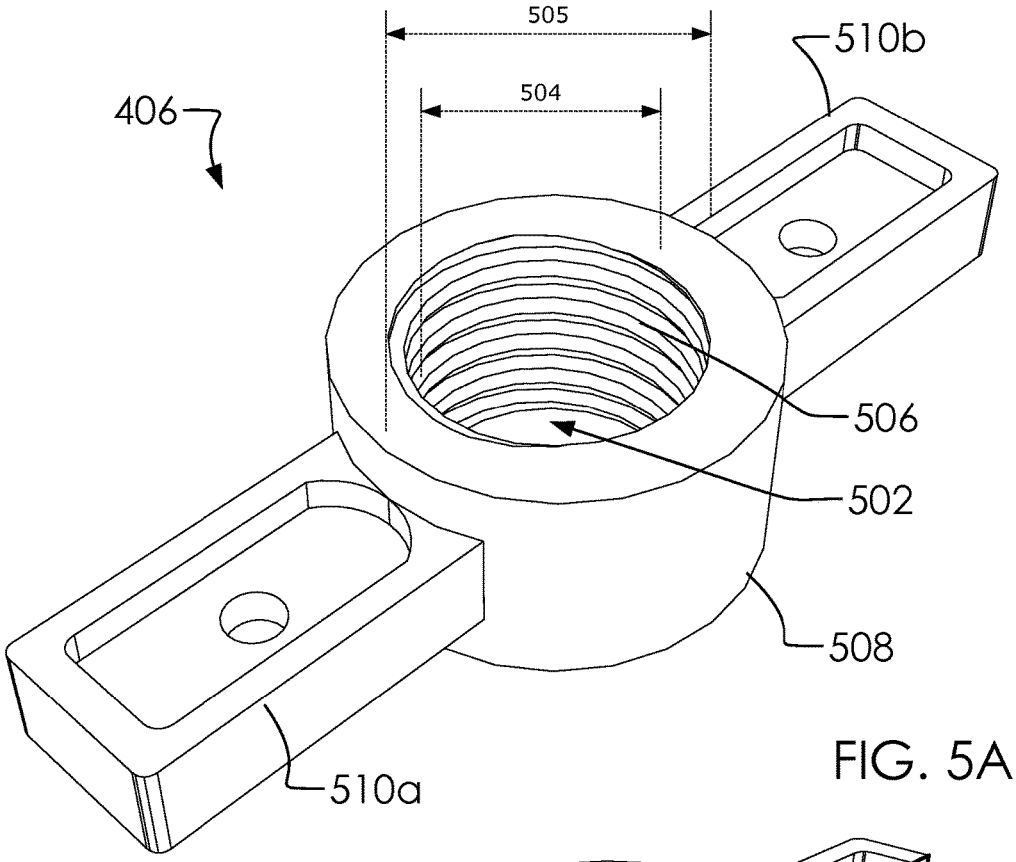
FIGS. 5A and 5B illustrate a solid line and a cross-section perspective overview of said threaded collar.
Figure 5B:
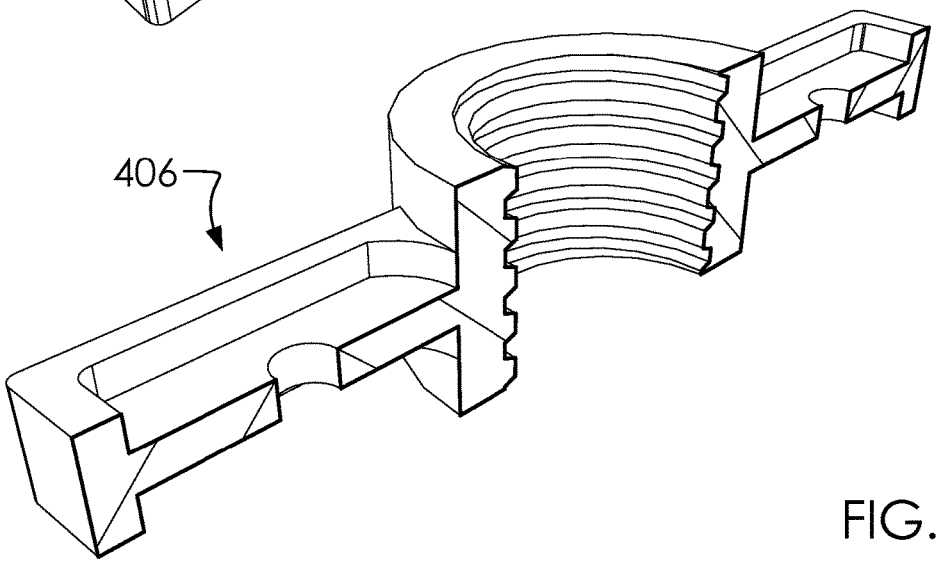

FIGS. 5A and 5B illustrate a solid line and a cross-section perspective overview of said threaded collar 406. In one embodiment, said threaded collar 406 can comprise a central collar aperture 502 having an internal diameter 504, and an external diameter 505. In one embodiment, said central collar aperture 502 can comprise a substantially cylindrical shape and an internal threading 506. In one embodiment, said central collar aperture 502 can comprise an inner surface of a ring portion 508 of said threaded collar 406. In one embodiment, said threaded collar 406 can further comprise a first handle 510*a* and a second handle 510*b*, capable of providing a leverage point to apply torque to said threaded collar 406, as necessary.

FIGS. 6A, 6B, 6C and 6D illustrate a solid view and a cross-section perspective overview of said drop-head 300 and of said fixed beam-head 301. In one embodiment, said drop-head 300 can comprise a central shaft 602, a drop-head top plate 604, a bottom plate 606, a first end cap seat 430*a*, a star 610 and a central drop-head aperture 612, as is known in the art. In one embodiment, said bottom plate 606 can comprise a plurality of fastening apertures which can comprise a first aperture 620*a* and a second aperture 620*b*.

Figure 6A:
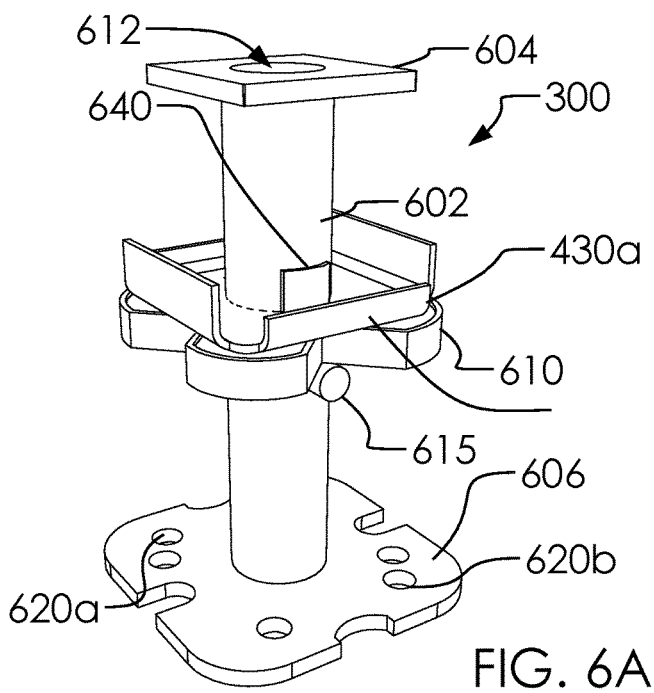
FIGS. 6A, 6B, 6C and 6D illustrate a solid view and a cross-section perspective overview of said drop-head and of said fixed beam-head.
Figure 6B:
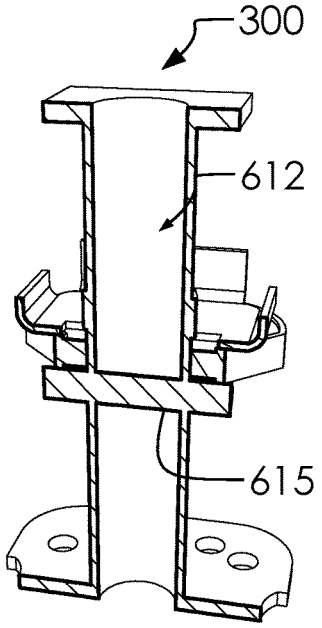
Figure 6C:
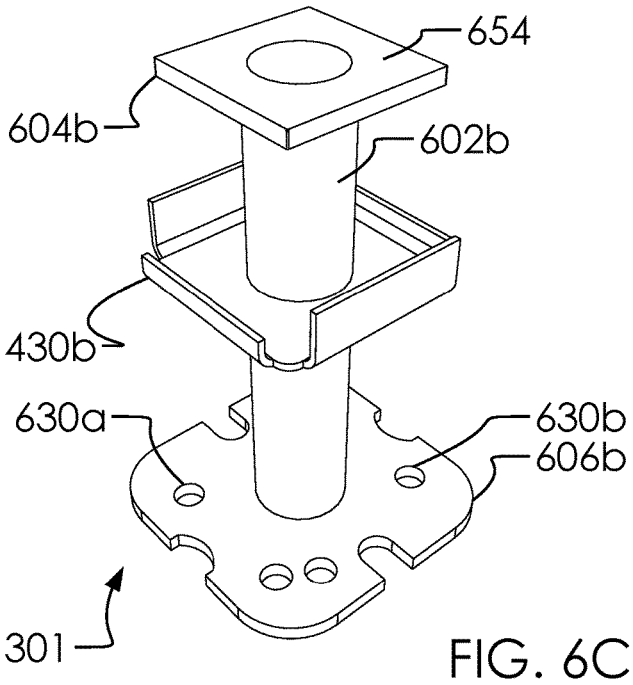
Figure 6D:
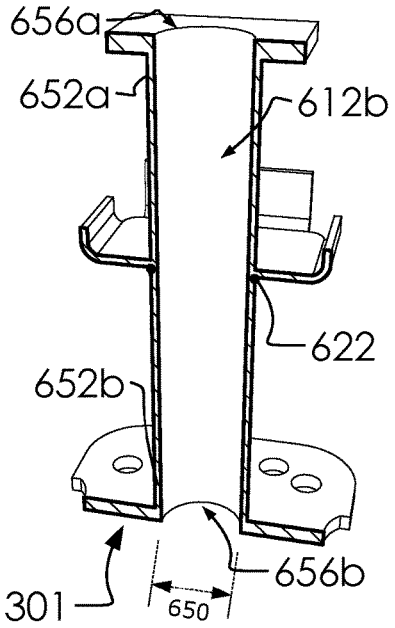

In one embodiment, said fixed beam-head 301 can comprise a second end cap seat 430*b*, a central shaft 602*b*, a fixed beam-head top plate 604*b*, a central fixed beam-head aperture 612*b* and a bottom plate 606*b*. In one embodiment, said second end cap seat 430*b* can be attached to said central shaft 602*b* of said fixed beam-head 301 at a welding point 622. In one embodiment, said fixed beam-head 301 can comprise said second end cap seat 430*b* in a fixed location which cannot be easily be removed in the manner that said first end cap seat 430*a* is removed from said drop-head 300. In one embodiment, said bottom plate 606*b* can comprise a plurality of fastening apertures which can comprise a first aperture 630*a* and a second aperture 630*b*. As illustrated in FIG. 6D, said fixed beam-head 301 can comprise a single weld-free uniform body, or can comprise two or more pieces having been welded together, as described above. In one embodiment, said central fixed beam-head aperture 612*b* of said fixed beam-head 301 can comprise an internal diameter 650. In one embodiment, said central shaft 602*b* can comprise a first end 652*a* and a second end 652*b*. In one embodiment, said fixed beam-head top plate 604*b* is attached or uniformly a portion of said central shaft 602*b* at said first end 652*a*; and said bottom plate 606*b* is attached or uniformly a portion of said central shaft 602*b* at said second end 652*b*. In one embodiment, said fixed beam-head top plate 604*b* can comprise a platform 654 whereupon said threaded collar 406 can sit when said upper portion 400*a* is inserted into a portion of said lower portion 400*b*. In one embodiment, said central shaft 602*b* can comprise a first end opening 656*a* at said first end 652*a* and a second end opening 656*b* at said second end 652*b*.

In one embodiment, said drop-head 300 can comprise an external pin 615 and a one or more stop-tabs 640, as is known in the art. In one embodiment, said first end cap seat 430*a* and said star 610 can be held between said external pin 615 and said one or more stop-tabs 640. In one embodiment, said fixed beam-head 301 can comprise said one or more stop-tab 640, but not always, as illustrated here.

Figure 7A:
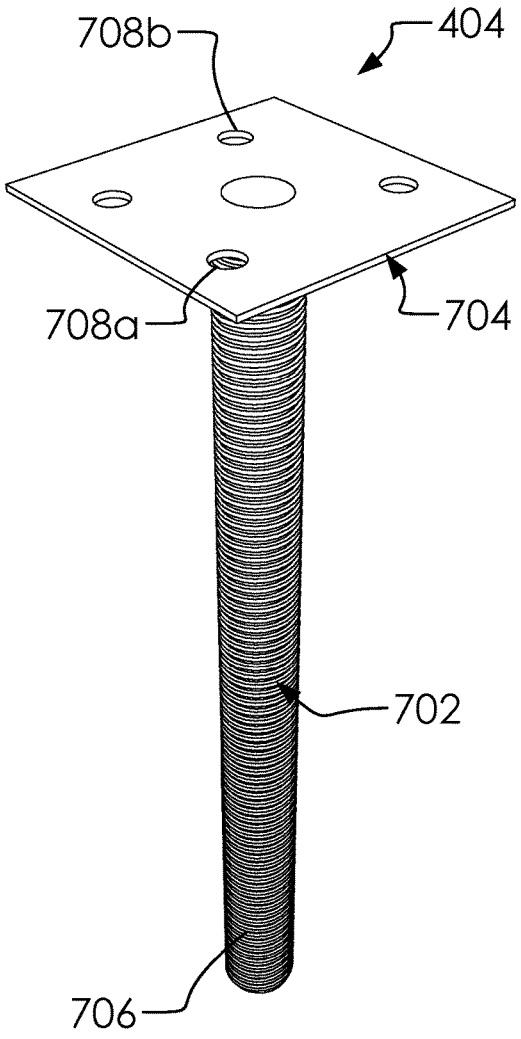
FIGS. 7A and 7B illustrate a solid view and a cross-section perspective overview of said screw-jack threaded shaft assembly.
Figure 7B:
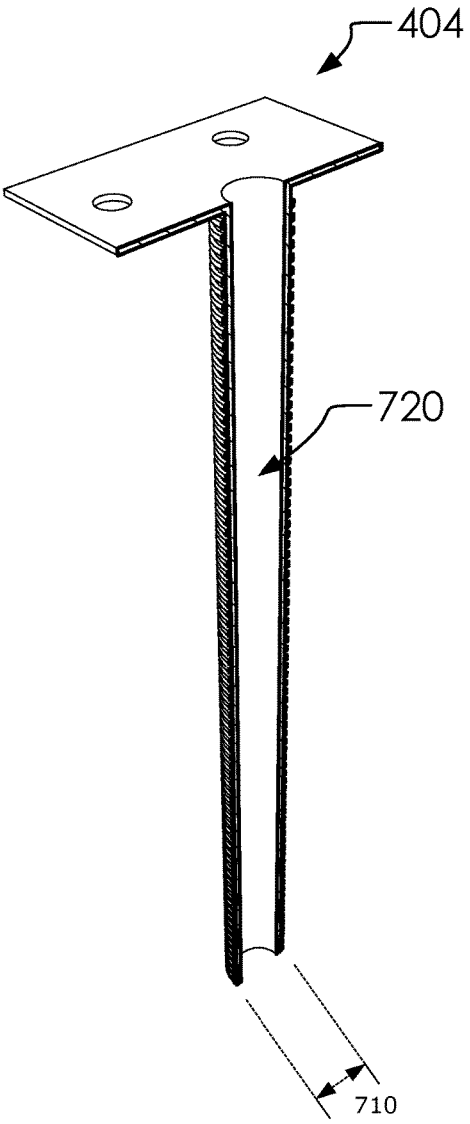

FIGS. 7A and 7B illustrate a solid view and a cross-section perspective overview of said screw-jack threaded shaft assembly 404. In one embodiment, said screw-jack threaded shaft assembly 404 can comprise a threaded shaft 702 and an upper attachment plate 704. In one embodiment, said threaded shaft 702 can comprise an external threading 706; and said upper attachment plate 704 can comprise a plurality of fastening apertures (which can comprise a first aperture 708*a* and a second aperture 708*b*). In one embodiment, said threaded shaft 702 can comprise a substantially cylindrical shape being of an external diameter 710 appropriate for threading through said central collar aperture 502, as is known in the art. Thus, in one embodiment said external diameter 710 of said threaded shaft 702 is equal to or smaller than said internal diameter 504 of said central collar aperture 502 of said threaded collar 406. In one embodiment, said threaded shaft 702 can comprise a central screw-jack aperture 720 which can comprise a substantially cylindrical tube shape having an opening at it endings.

Figure 8A:
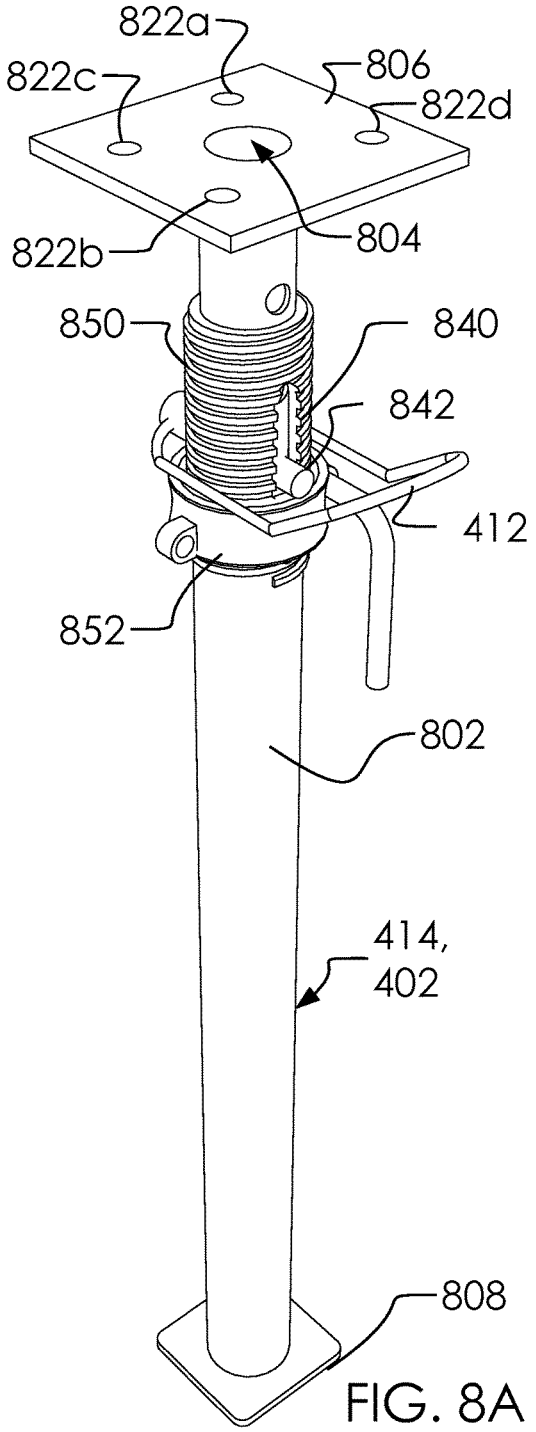
FIGS. 8A and 8B illustrate a solid view and a cross-section perspective overview perspective overview of said prop.
Figure 8B:
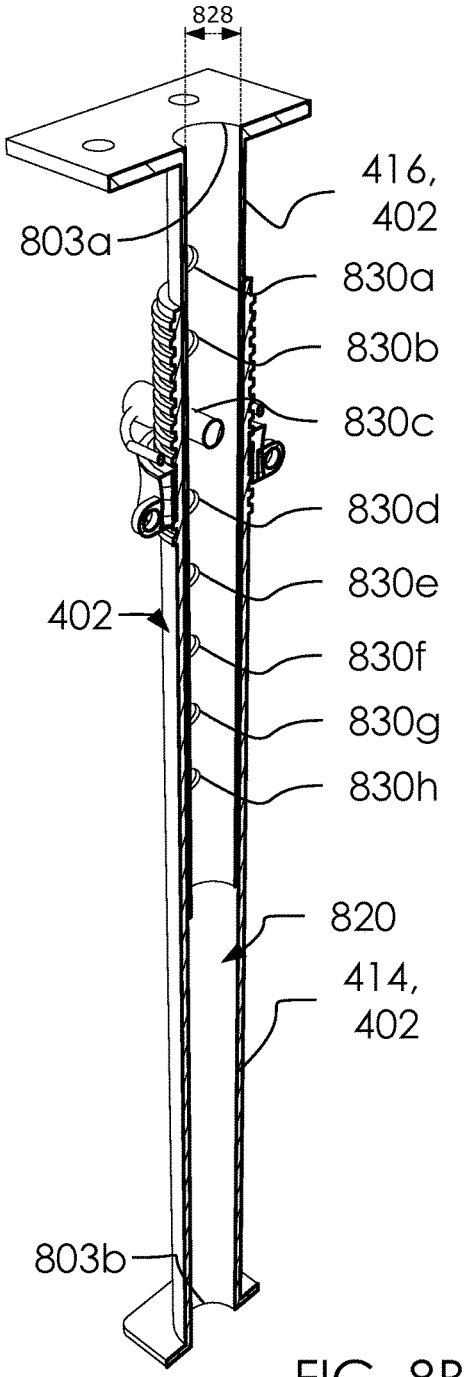

FIGS. 8A and 8B illustrate a solid view and a cross-section perspective overview perspective overview of said prop 402. In one embodiment, said prop 402 can comprise a central shaft 802 (having a first end 803*a* and a second end 803*b*), a first end aperture 804 (at said first end 803*a*), a prop top plate 806, and a foot 808, and a central prop aperture 820 (which can comprise a substantially cylindrical tube shape having an opening at it endings) as is known in the art. In one embodiment, said central prop aperture 820 can comprise an internal diameter 828 at said first end 803*a*. In one embodiment, said prop top plate 806 can comprise a plurality of fastening apertures (which can comprise a first aperture 822*a*, a second aperture 822*b*, a third aperture 822*c*, and a fourth aperture 822*d*).

In one embodiment, said upper interior portion 416 of said prop 402 can comprise a plurality of side apertures (which can comprise a first aperture 830*a*, a second aperture 830*b*, a third aperture 830*c*, a fourth aperture 830*d*, a fifth aperture 830*e*, a sixth aperture 830*f*, a seventh aperture 830*g*, and an eighth aperture 830*h*). In one embodiment, attaching said upper interior portion 416 to said lower exterior portion 414 can comprise: aligning said plurality of side apertures of said upper interior portion 416 with an exterior aperture 840 of said lower exterior portion 414; inserting a locking element 842 through said exterior aperture 840 and one of said plurality of side apertures; and locking said prop lock 412 in place, as is known in the art. In one embodiment, said prop lock 412 can comprise a threaded ring 852 which selectively attaches to an external threading 850 of said lower exterior portion 414.

Figure 9A:
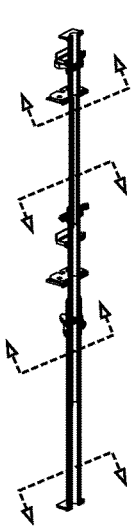
FIGS. 9A and 9B illustrate a cross-section perspective overview and a cross-section elevated front view of said prop assembly.
Figure 9B:
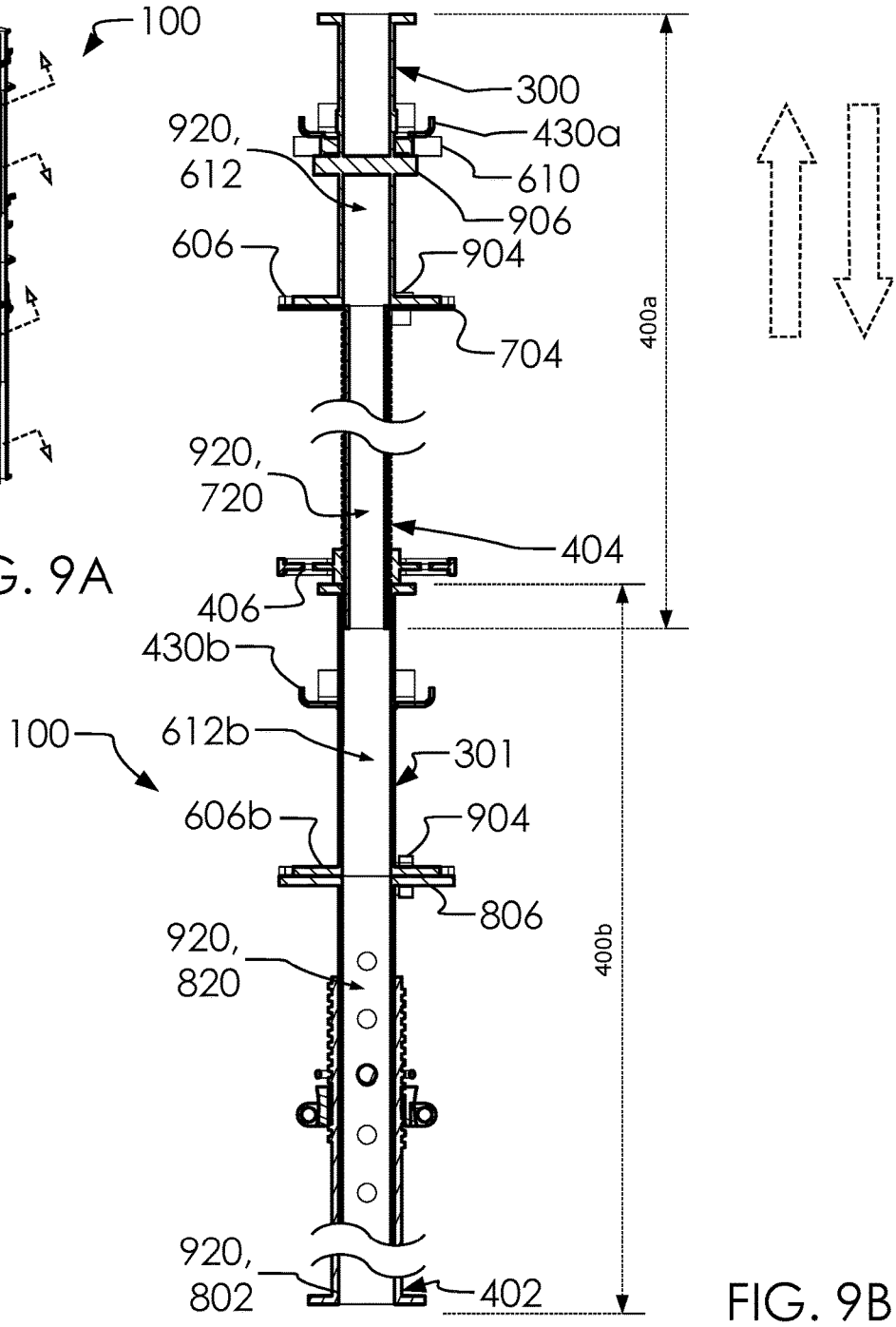

FIGS. 9A and 9B illustrate a cross-section perspective overview and a cross-section elevated front view of said prop assembly 100. FIG. 9A comprises dashed lines to indicate which portions of said prop assembly 100 are illustrated in FIG. 9B. In one embodiment, a portion of said threaded shaft 702 selectively slides into and out of a lower central shaft 920 (which can comprise said central fixed beam-head aperture 612*b* and said central prop aperture 820). In one embodiment, said threaded collar 406 provides a relative locking mechanism for holding said upper portion 400*a* (that is said screw-jack threaded shaft assembly 404 and said drop-head 300) to a particular height above said lower portion 400*b*.

In one embodiment, said bottom plate 606 of said drop-head 300 releaseably attaches to said upper attachment plate 704 with a one or more nut and bolt assemblies 904, as is known in the art. Likewise, in one embodiment, said prop top plate 806 releaseably attaches to said bottom plate 606*b* with a one or more nut and bolt assemblies 904, as is known in the art.

In one embodiment, said lower central shaft 920 of said lower portion 400*b* comprises said internal diameter 830 being larger than said external diameter 710 of said threaded shaft 702. In one embodiment, said upper portion 400*a* adjustably attaches to said lower portion 400*b* by: selectively sliding said threaded shaft 702 in an up and down direction through said lower central shaft 920 of said lower portion 400*b*; and vertically adjusting said threaded collar 406 along said threaded shaft 702 to fix a variable height of said prop assembly 100.

Figure 10A:
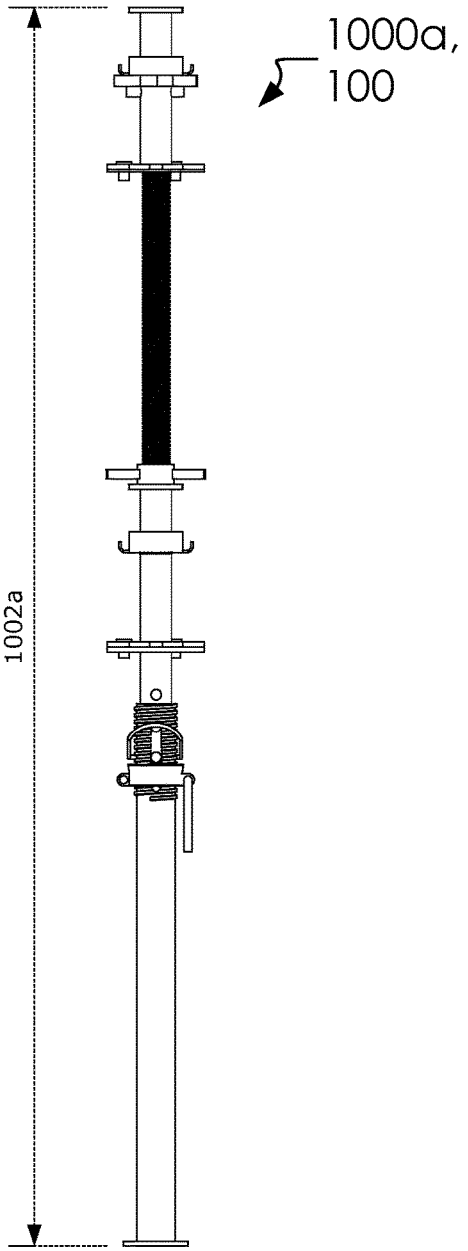
FIGS. 10A and 10B illustrate two elevated front views of said prop assembly, first in a tall configuration having a first height and a then in a short configuration having a second height.
Figure 10B:
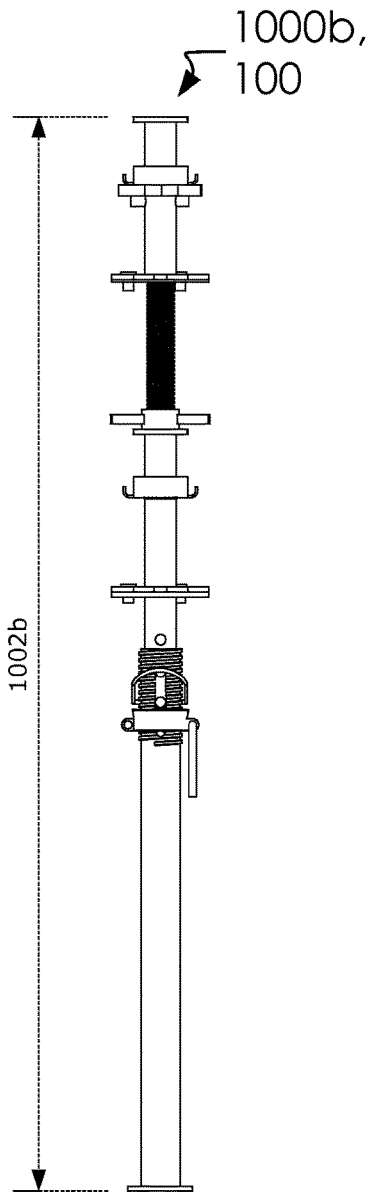

FIGS. 10A and 10B illustrate two elevated front views of said prop assembly 100, first in a tall configuration 1000*a* having a first height 1002*a* and a then in a short configuration 1000*b* having a second height 1002*b*.

Figure 11A:
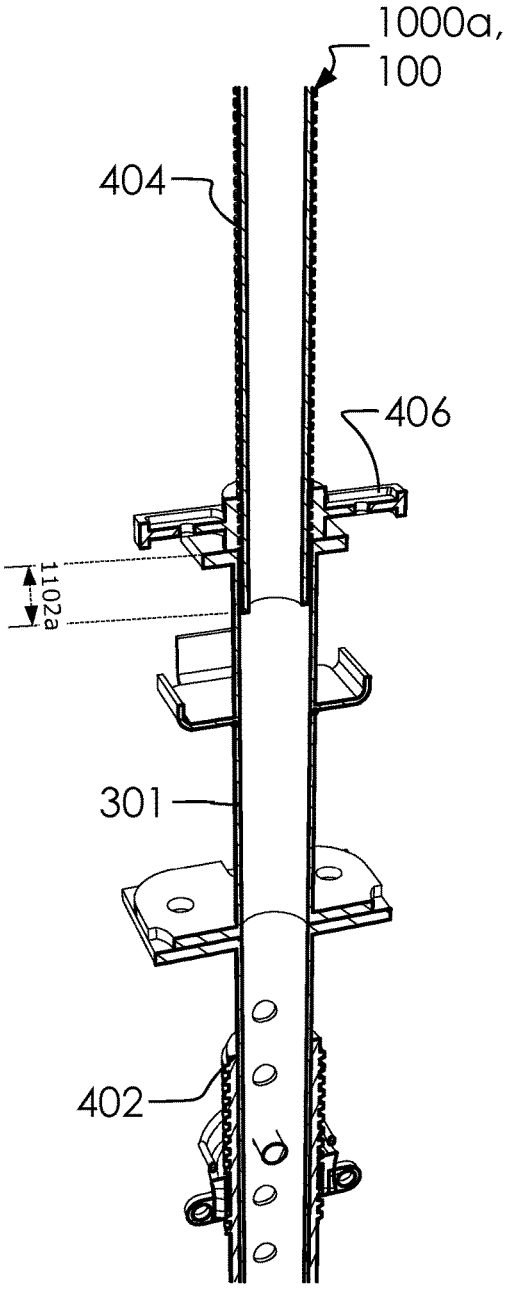
FIGS. 11A and 11B illustrate two perspective cross-section overviews of said prop assembly, first in said tall configuration and then in said short configuration.
Figure 11B:
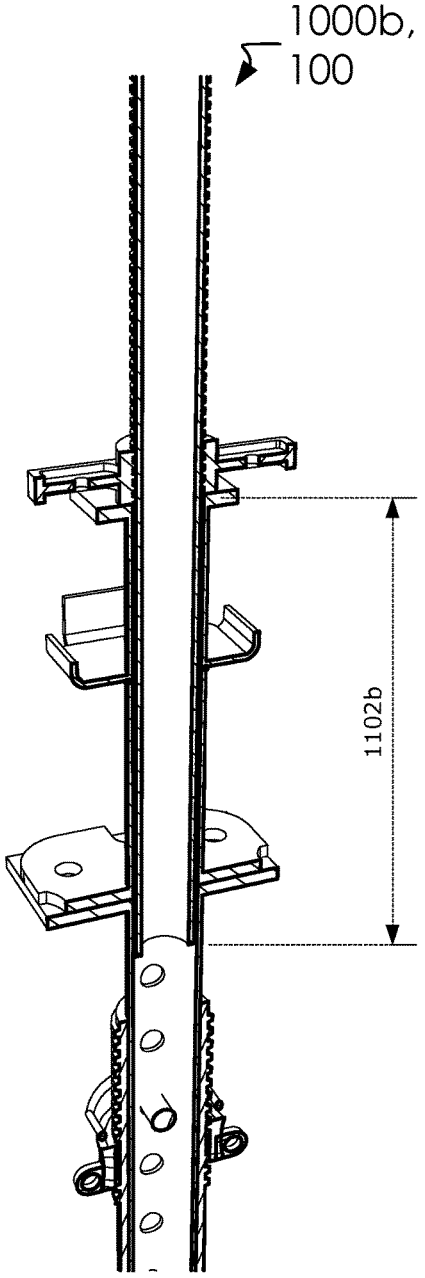

FIGS. 11A and 11B illustrate two perspective cross-section overviews of said prop assembly 100, first in said tall configuration 1000*a* and then in said short configuration 1000*b*. In one embodiment, said screw-jack threaded shaft assembly 404 can retract into said lower portion 400*b* (that is said prop 402 and said threaded collar 406) to a small overlap 1102*a* or a large overlap 1102*b*, as illustrated. In one embodiment, said small overlap 1102*a* can comprise a less stable version of said prop assembly 100 since lateral pressures put on said prop assembly 100 may cause said threaded collar 406 and/or said screw-jack threaded shaft assembly 404 to become disengaged from said lower portion 400*b*, accordingly, said large overlap 1102*b* can be safer than said small overlap 1102*a*.

Figure 12:
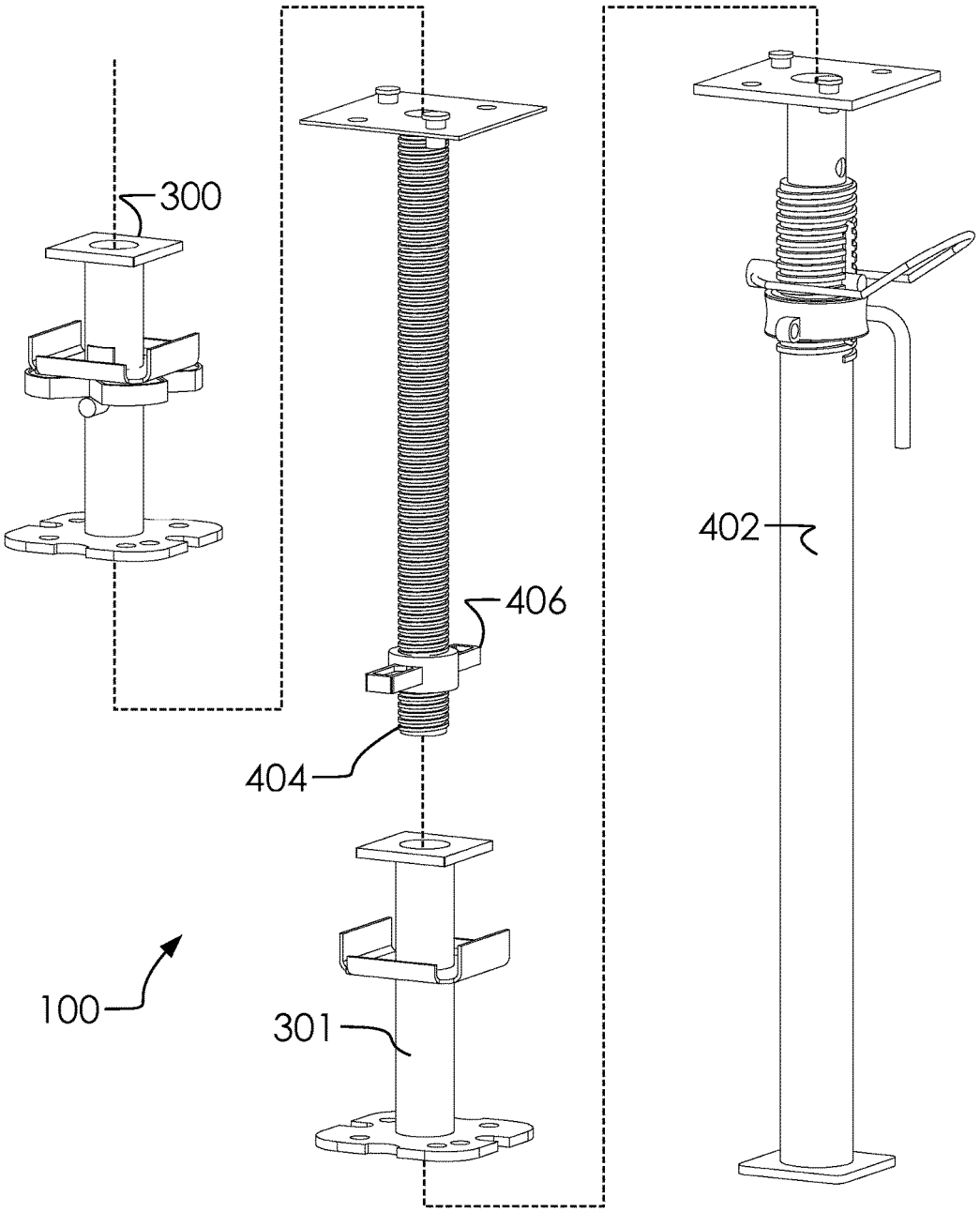
FIG. 12 illustrates said prop assembly in an exploded perspective overview.

FIG. 12 illustrates said prop assembly 100 in an exploded perspective overview.

Figure 13A:
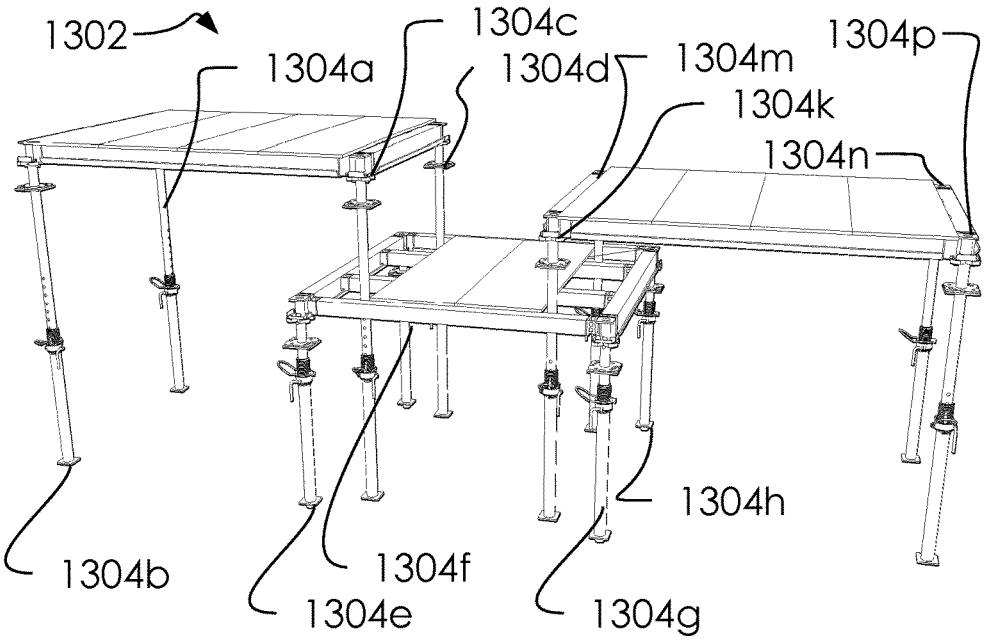
FIGS. 13A and 13B illustrate a perspective overview and an elevated front view of a prior art grid system.
Figure 13B:
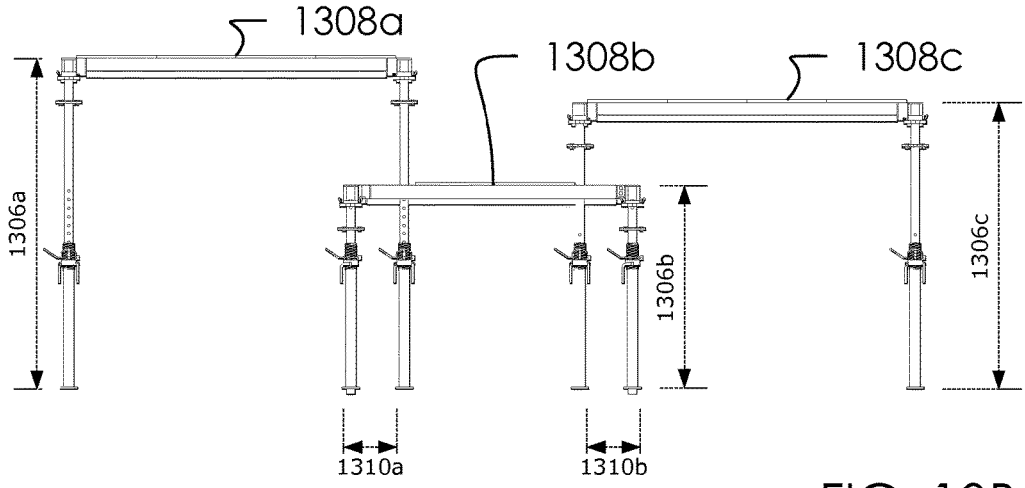

FIGS. 13A and 13B illustrate a perspective overview and an elevated front view of a prior art grid system 1302. In one embodiment, said prior art grid system 1302 can comprise a plurality of traditional props (which can comprise a first traditional prop 1304*a*, a second traditional prop 1304*b*, a third traditional prop 1304*c*, a fourth traditional prop 1304*d*, a fifth traditional prop 1304*e*, a sixth traditional prop 1304*f*, a seventh traditional prop 1304*g*, an eighth traditional prop 1304*h*, a ninth traditional prop 1304*k*, a tenth traditional prop 1304*m*, a eleventh traditional prop 1304*n*, and a twelfth traditional prop 1304*p*). In one embodiment, said plurality of traditional props can comprise embodiments of said traditional prop assembly 120, and therefore, said prior art grid system 1302 can comprise a prior art illustration.

In one embodiment, said prior art grid system 1302 can comprise of a one or more sets of props and beams (which can comprise a first set 1308*a* having a first height 1306*a*, a second set 1308*b* having a second height 1306*b*, and a third set 1308*c* having a third height 1306*c*). In one embodiment, said one or more sets of props and beams can be arranged with an overlap between each set so as to accommodate different height preferences for said beams. For example, in one embodiment, said first set 1308*a* can be at said first height 1306*a* and said second set 1308*b* can be at said second height 1306*b*, and an overlapping portion 1310*a* can be included. Likewise, an overlapping portion 1310*b* can be used between said second set 1308*b* and said third set 1308*c*, as illustrated.

Various changes in the details of the illustrated operational methods are possible without departing from the scope of the following claims. Some embodiments may combine the activities described herein as being separate steps. Similarly, one or more of the described steps may be omitted, depending upon the specific operational environment the method is being implemented in. It is to be understood that the above description is intended to be illustrative, and not restrictive. For example, the above-described embodiments may be used in combination with each other. Many other embodiments will be apparent to those of skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein."

The invention claimed is:

1. An improved grid shoring system comprising:

one or more fixed beam-head prop assemblies supporting one or more beams;

each of said one or more fixed beam-head prop assemblies comprise an upper portion, a lower portion, a variable height, and a threaded collar;

said upper portion having a screw-jack threaded shaft assembly;

said screw-jack threaded shaft assembly comprises a threaded shaft having an external diameter and an external threading and an upper attachment plate having a plurality of fastening apertures;

said upper portion of said one or more fixed beam-head prop assemblies selectively slide into said lower portion of said one or more fixed beam-head prop assemblies;

said threaded collar comprises an internal threading and an internal diameter;

said internal threading of said threaded collar rotateably attaches to said external threading of said screw-jack threaded shaft assembly of said upper portion;

said lower portion comprises a lower central shaft having an internal diameter being larger than said external diameter of said threaded shaft;

said upper portion and said lower portion adjustably attach to one another by selectively sliding said threaded shaft in an up and down direction through said lower central shaft of said lower portion, and vertically adjusting said threaded collar along said threaded shaft to select said variable height;

said upper portion comprises a first end cap seat;

said lower portion comprises a second end cap seat;

said upper portion having a drop-head;

said drop-head comprises a bottom plate having a plurality of fastening apertures;

said screw-jack threaded shaft assembly attaches to said drop-head by aligning said plurality of fastening apertures of said bottom plate of said drop-head with said plurality of fastening apertures of said upper attachment plate of said screw-jack threaded shaft assembly, and inserting and locking one or more nut and bolt assemblies through said plurality of fastening apertures in said bottom plate and said upper attachment plate;

said first end cap seat is selectively attached to said drop-head of said upper portion;

said first end cap seat comprises a variable height;

adjusting said variable height of said first end cap seat comprises adjusting said threaded collar between said upper portion and said lower portion of said one or more fixed beam-head prop assemblies;

said lower portion comprising of a prop and a fixed beam-head;

said fixed beam-head comprising a central shaft having a central fixed beam-head aperture having an internal diameter, a first end and a second end, a bottom plate having a plurality of fastening apertures, and a second end cap seat attached around and to said central shaft;

said prop comprising a central shaft having a first end and a second end, and a prop top plate having a plurality of fastening apertures;

said central shaft of said prop comprises central prop aperture having a first end aperture and an internal diameter; and said plurality of fastening apertures of said prop top plate of said prop align and attach to said plurality of fastening apertures of said bottom plate of said fixed beam-head.

2. An improved grid shoring system comprising:

one or more fixed beam-head prop assemblies supporting one or more beams;

each of said one or more fixed beam-head prop assemblies comprise an upper portion, a lower portion, a variable height, and a threaded collar;

said upper portion having a screw-jack threaded shaft assembly;

said screw-jack threaded shaft assembly comprises a threaded shaft having an external diameter and an external threading and an upper attachment plate having a plurality of fastening apertures;

said upper portion of said one or more fixed beam-head prop assemblies selectively slide into said lower portion of said one or more fixed beam-head prop assemblies;

said threaded collar comprises an internal threading and an internal diameter;

said internal threading of said threaded collar rotateably attaches to said external threading of said screw-jack threaded shaft assembly of said upper portion;

said lower portion comprises a lower central shaft having an internal diameter being larger than said external diameter of said threaded shaft;

said upper portion and said lower portion adjustably attach to one another by selectively sliding said threaded shaft in an up and down direction through said lower central shaft of said lower portion, and vertically adjusting said threaded collar along said threaded shaft to select said variable height;

said upper portion comprises a first end cap seat;

said lower portion comprises a second end cap seat;

said upper portion comprises a drop-head;

said drop-head comprises a bottom plate having a plurality of fastening apertures;

said screw-jack threaded shaft assembly attaches to said drop-head by aligning said plurality of fastening apertures of said bottom plate of said drop-head with said plurality of fastening apertures of said upper attachment plate of said screw-jack threaded shaft assembly, and inserting and locking one or more nut and bolt assemblies through said plurality of fastening apertures in said bottom plate and said upper attachment plate;

said drop-head comprising a first end cap seat, a star and an external pin.

3. The improved grid shoring system of claim 2, wherein:

said plurality of apertures of said upper attachment plate comprises at least a first aperture and a second aperture;

said plurality of apertures of said bottom plate of said drop-head comprises at least a first aperture and a second aperture; and at least said first aperture and said second aperture of said bottom plate of said drop-head and said upper attachment plate of said screw-jack threaded shaft assembly align with one another and receive said one or more nut and bolt assemblies to hold said drop-head to said screw-jack threaded shaft assembly.

4. The improved grid shoring system of claim 2, wherein:

said first end cap seat is selectively attached to said drop-head of said upper portion;

said first end cap seat comprises a variable height; and adjusting said variable height of said first end cap seat comprises adjusting said threaded collar between said upper portion and said lower portion of said one or more fixed beam-head prop assemblies.

5. The improved grid shoring system of claim 2, further comprising:

said threaded collar comprises a ring portion having a central collar aperture;

said central collar aperture being cylindrical and having said internal threading and said internal diameter; and said threaded collar further comprising a first handle extending out from said ring portion and providing leverage for turning said threaded collar relative to said screw-jack threaded shaft assembly.

6. The improved grid shoring system of claim 2, further comprising forming said improved grid shoring system with said one or more fixed beam-head prop assemblies by:

adjusting a height of each among said one or more fixed beam-head prop assemblies, arranging said one or more fixed beam-head prop assemblies, attaching said one or more fixed beam-head prop assemblies to one another with said one or more beams, and attaching one or more panels to said one or more beams.

7. The improved grid shoring system of claim 2, wherein:

said lower portion comprising of a prop and a fixed beam-head;

said fixed beam-head comprising a central shaft having a central fixed beam-head aperture having an internal diameter, a first end and a second end, a bottom plate having a plurality of fastening apertures, and a second end cap seat attached around and to said central shaft of said fixed beam-head;

said prop comprising a central shaft having a first end and a second end, and a prop top plate having a plurality of fastening apertures;

said central shaft of said prop comprises central prop aperture having a first end aperture and an internal diameter; and said plurality of fastening apertures of said prop top plate of said prop align and attach to said plurality of fastening apertures of said bottom plate of said fixed beam-head.

8. The improved grid shoring system of claim 7, wherein:

said prop comprises a prop lock, an upper interior portion and a lower exterior portion;

said prop lock selectively attaches to a portion of said lower exterior portion of said prop;

said upper interior portion comprises a plurality of side apertures; and said lower exterior portion attaches to said upper interior portion by aligning an external aperture of said lower exterior portion with a one of said plurality of side apertures, inserting a locking element through said external aperture and said one of said plurality of side apertures, and locking said prop lock in place.

9. The improved grid shoring system of claim 7, wherein:

said prop comprises a foot at said second end of said central shaft of said prop.

10. The improved grid shoring system of claim 7, wherein:

said second end cap seat of said fixed beam-head is welded to said central shaft of said fixed beam-head at a welding point.

11. The improved grid shoring system of claim 7, wherein:

said fixed beam-head comprises a fixed beam-head top plate comprising a platform;

said threaded collar sits on said platform when a portion of said upper portion is inserted into a portion of said lower portion;

said threaded collar comprises a ring portion having a central shaft;

said ring portion having an internal diameter; and said external diameter of said ring portion of said threaded collar is larger than said internal diameter of said central shaft of said fixed beam-head.

12. The improved grid shoring system of claim 7, further comprising:

an upper portion having a drop-head;

a first end cap seat being selectively attached to said drop-head; and said second end cap seat of said fixed beam-head is affixed to said fixed beam-head.

13. A method of using an improved grid shoring system, comprising:

supporting one or more beams on a first end cap seat and a second end cap seat of one or more fixed beam-head prop assemblies;

selectively adjusting a height of said first end cap seat by sliding a threaded shaft in an up and down direction through a lower central shaft of a lower portion, and vertically adjusting a threaded collar along said threaded shaft to select a variable height;

attaching a lower exterior portion of a prop to an upper interior portion comprises aligning an external aperture of said lower exterior portion with a one of said plurality of side apertures, inserting a locking element through said external aperture and said one of said plurality of side apertures, and locking a prop lock in place; wherein, said lower portion comprises said prop having said lower exterior portion, said upper interior portion, and said prop lock; and said one or more fixed beam-head prop assemblies comprise said lower portion having a central fixed beam-head shaft, an upper portion having said threaded shaft, said threaded collar.

14. The method of using an improved grid shoring system of claim 13, further comprising:

attaching a screw-jack threaded shaft assembly to a drop-head comprises:

aligning a plurality of fastening apertures of a bottom plate of said drop-head with a plurality of fastening apertures of an upper attachment plate of said screw-jack threaded shaft assembly, and inserting and locking one or more nut and bolt assemblies through said plurality of fastening apertures in said bottom plate and said upper attachment plate;

and wherein, said upper portion comprises said drop-head and said screw-jack threaded shaft assembly, and said drop-head comprises said bottom plate having said plurality of fastening apertures.

15. The method of using an improved grid shoring system of claim 13, further comprising:

forming said improved grid shoring system with said one or more fixed beam-head prop assemblies by:

adjusting a height of each among said one or more fixed beam-head prop assemblies, arranging said one or more fixed beam-head prop assemblies, attaching said one or more fixed beam-head prop assemblies to one another with said one or more beams, and attaching one or more panels to said one or more beams.

16. An improved grid shoring system comprising:

one or more fixed beam-head prop assemblies supporting one or more beams;

each of said one or more fixed beam-head prop assemblies comprise an upper portion, a lower portion, a variable height, and a threaded collar;

said upper portion having a screw-jack threaded shaft assembly;

said screw-jack threaded shaft assembly comprises a threaded shaft having an external diameter and an external threading and an upper attachment plate having a plurality of fastening apertures;

said upper portion of said one or more fixed beam-head prop assemblies selectively slide into said lower portion of said one or more fixed beam-head prop assemblies;

said threaded collar comprises an internal threading and an internal diameter;

said internal threading of said threaded collar rotateably attaches to said external threading of said screw-jack threaded shaft assembly of said upper portion;

said lower portion comprises a lower central shaft having an internal diameter being larger than said external diameter of said threaded shaft;

said upper portion and said lower portion adjustably attach to one another by selectively sliding said threaded shaft in an up and down direction through said lower central shaft of said lower portion, and vertically adjusting said threaded collar along said threaded shaft to select said variable height;

said upper portion comprises a first end cap seat;

said lower portion comprises a second end cap seat;

said upper portion comprises a drop-head;

said drop-head comprises a bottom plate having a plurality of fastening apertures;

said screw-jack threaded shaft assembly attaches to said drop-head by aligning said plurality of fastening apertures of said bottom plate of said drop-head with said plurality of fastening apertures of said upper attachment plate of said screw-jack threaded shaft assembly, and inserting and locking one or more nut and bolt assemblies through said plurality of fastening apertures in said bottom plate and said upper attachment plate;

said first end cap seat is selectively attached to said drop-head of said upper portion;

said first end cap seat comprises a variable height; and adjusting said variable height of said first end cap seat comprises adjusting said threaded collar between said upper portion and said lower portion of said one or more fixed beam-head prop assemblies.

* * * * *